United States Patent [19]

Steiner

[11] Patent Number: 4,724,969

[45] Date of Patent: Feb. 16, 1988

[54] CLOTHES DRYING APPARATUS

[76] Inventor: Walter Steiner, Saentisstrasse 52, CH-8311 Bruetten, Switzerland

[21] Appl. No.: 918,373

[22] Filed: Oct. 14, 1986

[30] Foreign Application Priority Data

Oct. 24, 1985 [EP] European Pat. Off. ..... 85113512.9

[51] Int. Cl.[4] ..... A47B 47/00

[52] U.S. Cl. ..... 211/197; 211/196; 211/119.01; 135/33 C

[58] Field of Search ..... 211/197, 196, 119.01, 211/1.3; 135/105, 33 R, 33 C; 160/53

[56] References Cited

FOREIGN PATENT DOCUMENTS

| | | | |
|---|---|---|---|
| 2458162 | 6/1976 | Fed. Rep. of Germany | 211/1.3 |
| 3200013 | 8/1983 | Fed. Rep. of Germany . | |
| 569794 | 11/1957 | Italy | 211/1.3 |
| 390863 | 3/1957 | Switzerland . | |

*Primary Examiner*—Ramon S. Britts

*Assistant Examiner*—Blair M. Johnson

*Attorney, Agent, or Firm*—Tarolli, Sundheim & Covell

[57] ABSTRACT

The invention provides a clothes drying apparatus with a central post member, a collar member axially displaceably mounted on the supporting post member and a plurality of support arms. A plurality of clothes line portions extend between the support arms.

Operating means are provided to spread the support arms from a rest position into an extended position in which the clothes line portions extending between the support arms are in an essentially tensioned condition. In order to avoid a contamination and muddling of the hanging down line portions when the apparatus is in its inoperative position, cavities are provided between the central post and the support arms which receive and protect the hanging down line portions. For this purpose the support arms are provided with rigidly or pivotally mounted blade members which cover these cavities.

13 Claims, 10 Drawing Figures

Fig. 7d
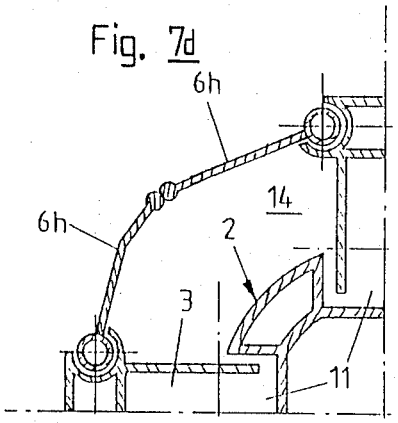
Fig. 7b
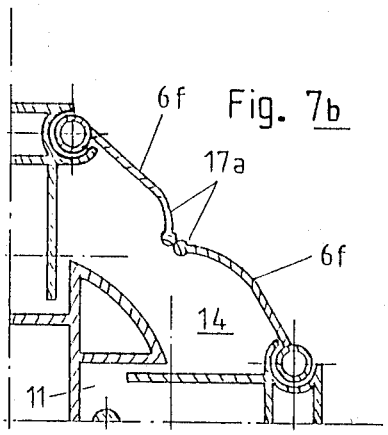
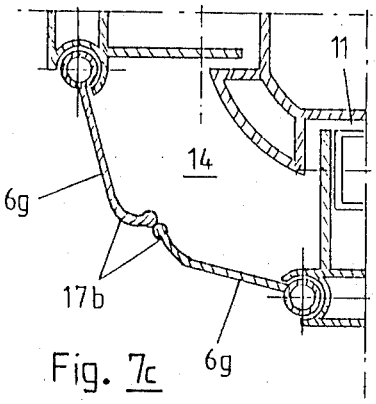
Fig. 7c
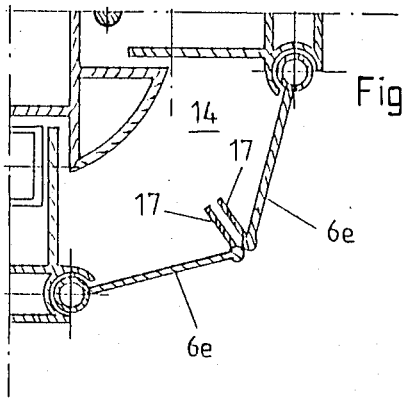
Fig. 7a

CLOTHES DRYING APPARATUS

BACKGROUND OF THE INVENTION

The present invention relates to a clothes drying apparatus which comprises a central, elongate supporting post member, a collar member surrounding the supporting post member which includes a plurality of radially protruding webs, this collar member being axially displaceably mounted on the supporting post member. The apparatus further comprises a plurality of support arms, one end thereof being pivotally mounted via a first joint on the radially protruding webs, and a clothes line constituting a plurality of clothes line portions which extend between the support arms.

The central supporting post member is equipped with a head member mounted on the top of the supporting post member, and a plurality of strut members, one end thereof being pivotally connected to the head member and the other end thereof being pivotally connected via a second joint to one of the support arms.

Operating means are provided to spread the support arms from a rest position in which the arms are in an essentially parallel position to the central supporting post member, into an extended or spread out position in which the clothes line portions extending between the support arms are in an essentially tensioned condition, by displacing the collar member from a lower rest position towards said head member into an operative position.

PRIOR ART

A clothes drying apparatus of this or a similar kind is known e.g. from Swiss Pat. No. 390,863, and further known from various different embodiments commercially available and in wide-spread use in households.

In such a known apparatus, there are several disadvantages: The support arms being in their inoperative rest position parallel to the central supporting post, the clothes line portions extending between the support arms loosely hang downwards. Consequently they are subject to contamination if the clothes drying apparatus is not enclosed by a (e.g. textile or plastic) cover, and they are easily muddled which makes a following spreading-out most inconvenient. Furthermore, if such a clothes drying apparatus is left standing at the place of use in its inoperative position, its appearance is non-esthetic as a result of the hanging down clothes line portions.

In order to avoid such disadvantages, it is proposed e.g. in German Patent Publication No. 32 00 013 to improve a clothes drying apparatus of the kind referred to by providing it with a clothes line pulling-back or retraction device which automatically pulls the clothes lines back into the support arm portions at the time of folding up the clothes drying apparatus into its inoperative position. In theory, of course, it should be possible to achieve the desired effect by providing such a retraction device, but, in fact, in comprises a great number of trouble-prone, wear-exposed parts. However, this is particularly not desired in a household article for daily use because such an article should function in a problem free manner for many years. There is also a cost factor because a relatively complicated retraction mechanism increases manufacturing costs of such a clothes drying apparatus to a considerable extent, particularly if a robust construction which is not sensitive to incorrect operation is required.

OBJECTS OF THE INVENTION

It is a primary object of the present invention to improve an clothes drying apparatus of the prior art as hereinbefore discussed in a completely different and hitherto unknown manner so that the aforementioned disadvantages no longer occur.

Particularly, it is an object of the invention to improve a clothes drying apparatus of the kind referred to in such a manner that it may be ensured without the need of a cumbersome, expensive and complicated mechanism to protect the hanging down clothes line portions against contamination and muddling if the apparatus is in its inoperative position, and to provide at the same time an esthetically attractive appearance of the collapsed, inoperative clothes drying apparatus.

SUMMARY OF THE INVENTION

The invention provides a clothes drying apparatus which comprises a central, elongate supporting post member with a collar member surrounding the supporting post member which collar includes a plurality of radially protruding webs. The collar member is axially displaceably mounted on the supporting post member.

The apparatus further comprises a plurality of support arms, one end thereof being pivotally mounted via a first joint on the radially protruding webs, and a clothes line comprising a plurality of clothes line portions extending between said support arms.

The supporting post member includes a head member mounted on the top of the supporting post member, and a plurality of strut members is provided, one end thereof being pivotally connected to the head member and the other end thereof being pivotally connected via a second joint to one of the support arms.

In order to spread the support arms from a rest position in which the arms are in an essentially parallel position with regard to the central support member into an extended position in which the clothes line portions extending between the support arms are in an essentially tensioned condition, operating means are provided which displace the collar member from a lower rest position towards the head member.

When the support arms are in said essentially parallel position with regard to said central supporting post, at least partially closed cavities are formed between the support arms and the central supporting post, said cavities being adapted to receive and enclose the downwardly hanging clothes line portions of said clothes line.

According to a first embodiment, the support arms are provided with laterally projecting blades extending at least along a part of their longitudinal extension. These blades, when said support arms are in their retracted inoperative position, together with the lateral faces of the support arms and the surface of the central supporting post, thereby form the cavities for receiving the downwardly hanging clothes line portions.

The laterally projecting blades may be rigidly fixed to said support arms, whereby the laterally projecting blades may be integrally formed with said support arms.

According to a second embodiment, said laterally projecting blades may be pivotally fixed to said support arms, whereby for the pivotable mounting of said laterally projecting blades, hinge-like joints may be provided which have stops for limiting the pivoting movement of the blades.

Preferably the support arms are provided on both sides with said projecting blades, and the arms are mounted on or fixed to the outer edges of the support arms remote from the central post member.

In order to assist the hanging down clothes line portions to be received in the cavities, the blades may be provided with guidance extensions arranged along their free longitudinal edges and which project towards the central post member, or the support arms may comprise guide members displaceably arranged along their length which are adapted to force the loosely downwardly hanging clothes line portions into the cavities when the support arms are folded together towards the central supporting post.

BRIEF DESCRIPTION OF THE DRAWING

In the following, some embodiments of the apparatus according to the invention will be further described, with reference to the enclosed drawings. In the drawings.

FIGS. 7*a* to 7*d* show partial cross sections in a horizontal plane through different modified variants of the fourth embodiment of the clothes drying apparatus according to the invention.

DESCRIPTION OF PREFERRED EMBODIMENTS

The general design of such an umbrella-like or spider's web-type clothes drying apparatus is adequately known from constructions thereof available in numerous households, as well as from the aforementioned publications, removing the need to give further detailed explanations or to present additional drawings.

Figure 1:
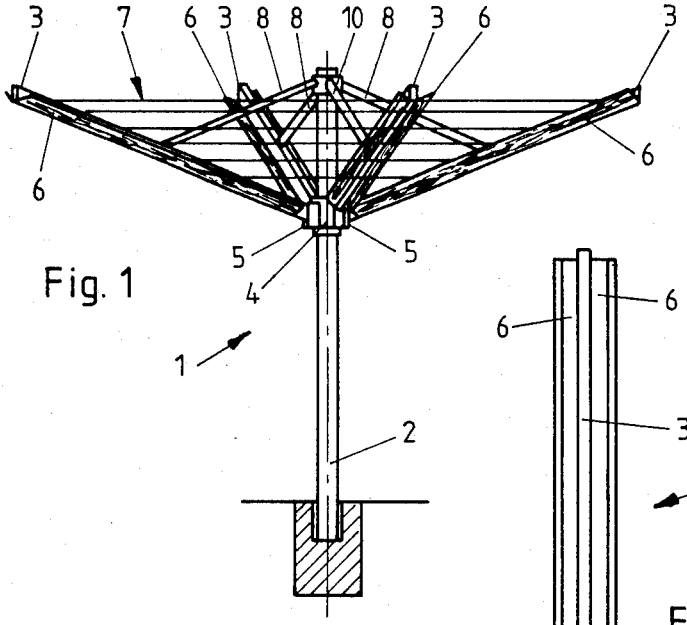
FIG. 1 shows a diagrammatic overall side view of an of a clothes drying apparatus according to the invention in its operative position, i.e. when extended.
Figure 3:
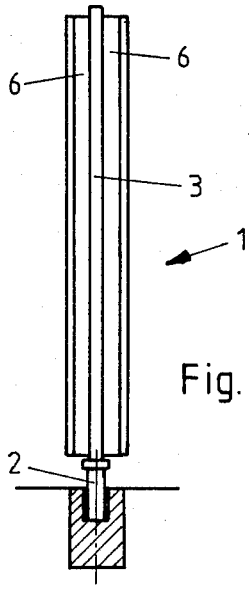
FIG. 3 shows a diagrammatic overall side view of the clothes drying apparatus of FIG. 1 in its inoperative, i.e. collapsed or folded position.

The clothes drying apparatus as shown in the attached drawing comprises a plurality, e.g. four support arms 3 which are arranged in equidistant relationship around a central, vertical supporting post 2. The support arms 3 together serve as a support for a clothes line 7 whose portions 7′ extend between the individual support arms 3 when said arms 3 are in their spread out position (i.e. in the operative position of the clothes drying apparatus), as shown in FIGS. 1 and 3.

The central post 2 comprises a slidably mounted collar 4 surrounding the post 2 and having four radially protruding webs 5. The lower ends of the four support arms 5 are pivotally mounted on the webs 5. Struts 8 are provided, one strut 8 being associated to each one supporting arm 3, one end thereof being pivotally mounted on the support arm 3 in a predetermined distance from the linkage 6 and the other end thereof, i.e. the end remote from the support arm 3, is pivotally mounted on a head member 10 arranged on the top of the central post 2.

When the clothes drying apparatus 1 is not in use, the support arms 3 are pivoted against the central post 2 and consequently also the struts 8. The collar 4 is in its lowermost position and the previously tensioned clothes line portions 7′ hang loosely down between the support arms 3.

In order to avoid a contamination and a tangling or muddling of the loosely hanging down clothes line portions 7′ if the clothes drying apparatus is in its collapsed inoperative position, the present invention generally discloses the provision of cavities adapted to receive the loosely hanging down portions 7′ of the clothes line. Those cavities are formed, the support arms 3 being in their folded-in rest position, between the central supporting post 2 and the support arms 3. These cavities can be formed by providing the support arms 3 on either side of their leading edge with projecting blade or vane members, generally designated 6 in FIGS. 1 to 3. As will be further explained hereinafter, these blade or vane members 6, together with the lateral surfaces of the support arms 3 and with certain areas of the outer surface of the central supporting post 2, define four cavities 14 for receiving the downwardly hanging clothes line portions as soon as the clothes drying apparatus 1 is in its collapsed inoperative position.

Figure 2:
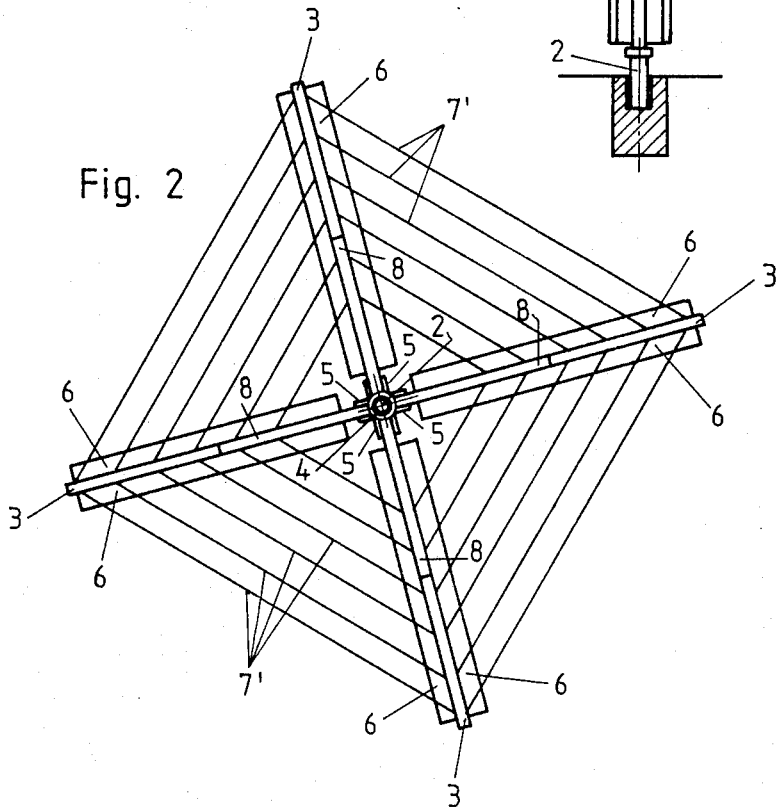
FIG. 2 shows an overall view of the embodiment of FIG. 1 from above.

This situation is shown in a diagrammatic side view in FIG. 2. Even from this diagrammatic view, it will be readily apparent the the clothes drying apparatus according to the invention offers an orderly an esthetic appearance when in collapsed inoperative position.

Within the scope of the invention, numerous different possibilities exist for the practical construction of a clothes drying apparatus which is able to meet the objects as set forth hereinbefore. Apart from an embodiment which is only mentioned in passing and not shown in the drawings, in which the central supporting post 2 has a relatively large cross-section and is provided with axially extending recesses adapted to be covered by the folded-in support arms 3, an appropriate and favourable solution would appear to be to provide the support arms 3 with laterally projecting blades or vanes, which are either rigidly or pivotally fixed to the support arms 3, preferably in the region of the leading edges thereof.

Figure 4:
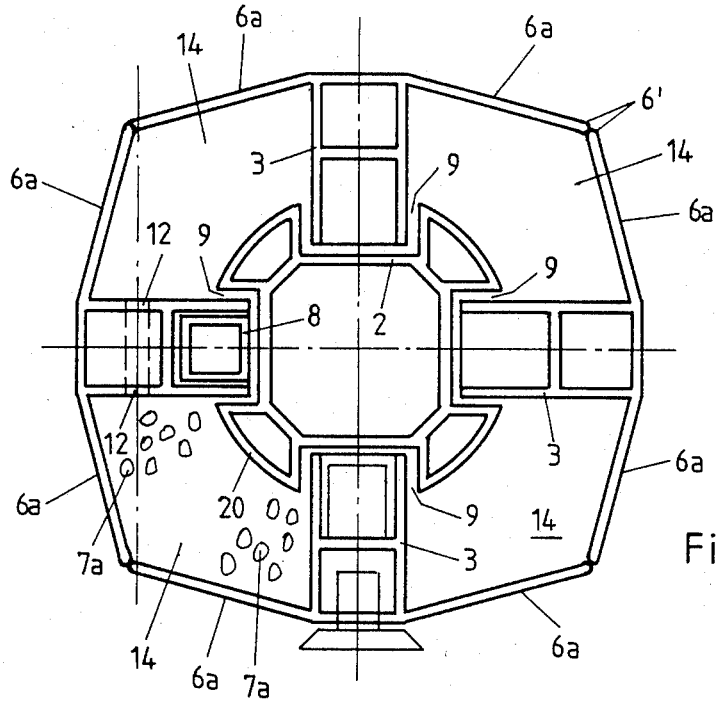
FIG. 4 shows a cross section in a horizontal plane through a second embodiment of a clothes drying apparatus according to the invention in the collapsed state.

A first embodiment of such a construction is shown in FIG. 4 as a cross sectional view in a horizontal plane through the closed, collapsed clothes drying apparatus. The central supporting post 2 is constituted by a generally cylindrically shaped hollow aluminium profile member which however comprises four axially extending longitudinal recesses 9 uniformly and equidistantially arranged around the outer surface of the profile member. These recesses 9 receive the support arms 3 in the inoperative position of the clothes drying apparatus 1, i.e. when the arms 3 are swung-in towards the post 2. The support arms are constituted by closed box-like profile members; such an arrangement gives a good stability with comparatively small cross-sectional dimensions.

The box-like profiles of the support arms 3 have a cavity 11 open towards the central post 2 in which the struts are received upon folding the apparatus together. The portion of the box-like profile constituting the support are 3 remote from the central post 2 is provided with openings 12 adapted to receive the clothes line 7. The outer closed end portion of the box-like profile members constituting the support arms 3 is provided, according to the embodiment shown in FIG. 4, with two blade or vane members 6a projecting therefrom and mounted in the region of the outer edge of the arm 3. According to the embodiment shown in FIG. 4, those blade members are part of the box-like profile member constituting the arm 3, i.e. they form part of the profile member. Futhermore, they extend slightly inclined from the lateral face 3a of the support arm 3 and enclose therewith a slightly acute angle. The width of the blades or vanes 6a is such that the free edge 6' of one of the blades or vanes is located in immediate vicinity of the free edge 6' of the adjacent blade or vane 6a or can even be in contact therewith.

Thus, the clothes drying apparatus being in its collapsed position, four cavities 14 are formed which are defined by the adjacent blade or vane members 6a, two adjacent outer surfaces 3a of two adjacent support arms 3 and an area 2a of the outer surface 2a of the central post member 2. These four cavities 14 receive and protect the hanging down clothes line portions 7a of the clothes line 7. The length of the blade or vane members 6a is such that it is ensured that the complete longitudinal extension of the hanging down line portions is covered or "packed". Thus the blade members 6a extend at least from the bore 12 provided for the outermost clothes line portion 7a to the deviation or deflection point of the innermost clothes line portion. Of course, the precise length is to be determined in each individual case.

Figure 5:
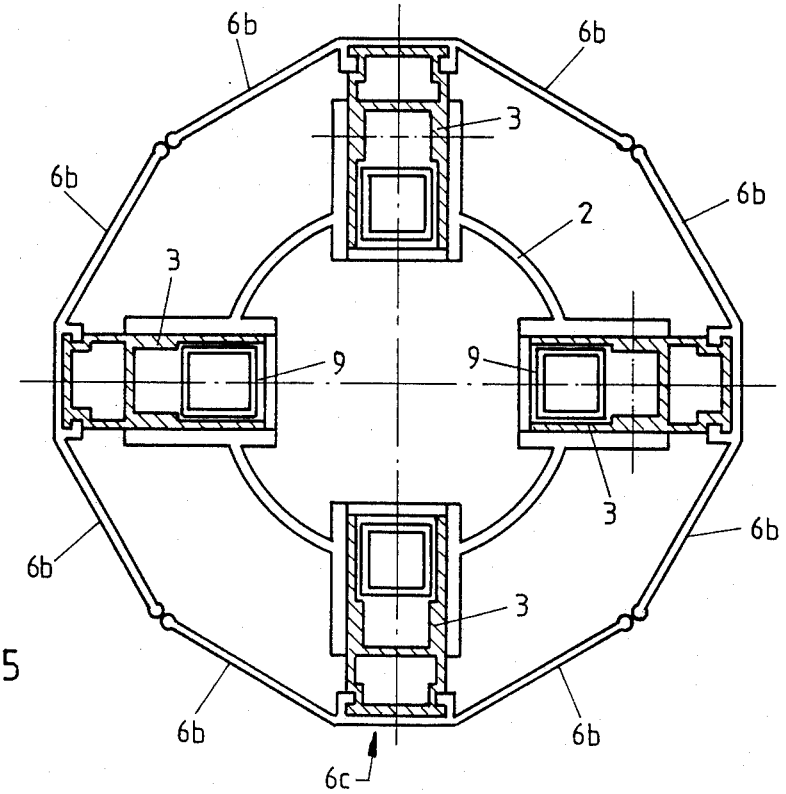
FIG. 5 shows a cross section in a horizontal plane through a third embodiment of a clothes drying apparatus according to the invention in the collapsed state.

FIG. 5 shows an embodiment having a similar construction as that shown in FIG. 4. Again, there is provided a central supporting post 2 having four circumferentially distributed axially extending recesses 9 adapted to receive the support arms 3 which are constituted by box-like profile members. In contrary to the embodiment shown in FIG. 4, in the case of the embodiment shown in FIG. 5 the blade members 6a are not shaped in one piece on the box-like profile members constituting the arms 3, but instead are in the form of separate double blade sections 6a slidably mounted on the end faces of the arms 3. Otherwise the basic construction is the same as far as the immovable arrangement, the angle between the arms 3 and the blades 6a as well as the dimensions are concerned.

Figure 6:
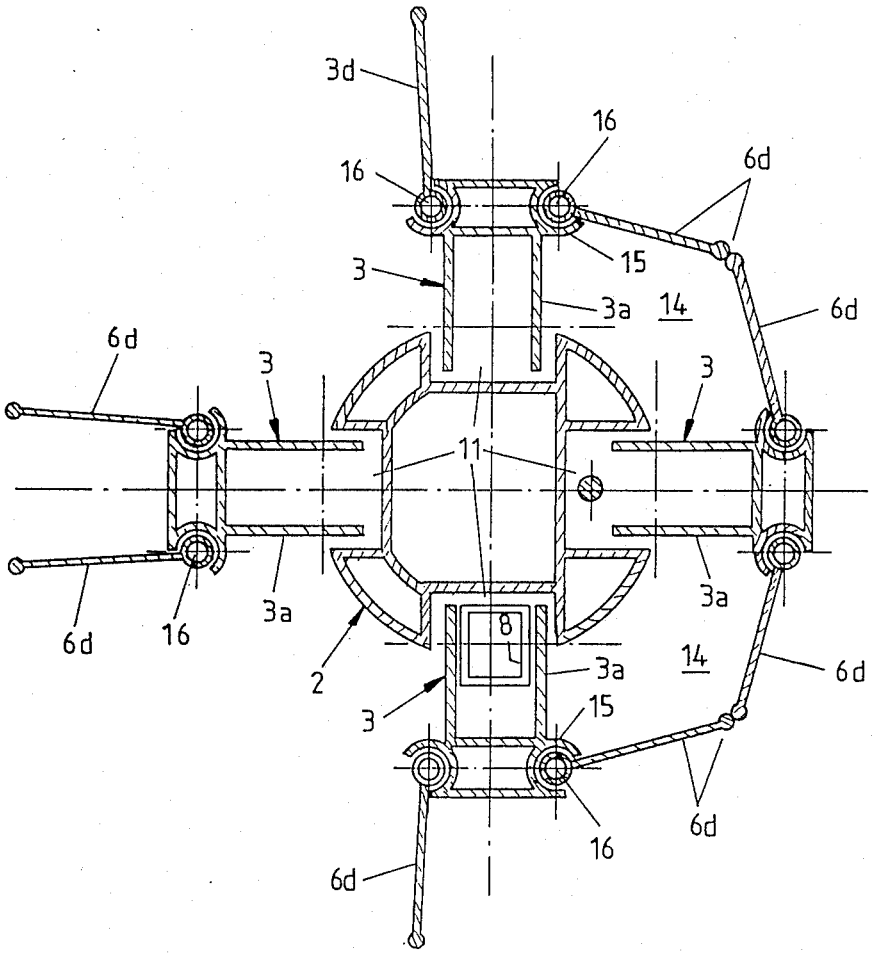
FIG. 6 shows a cross section in a horizontal plane through a fourth embodiment of a clothes drying apparatus according to the invention in the collapsed state.

In FIG. 6 there is shown a further embodiment in a corresponding view to the one as shown in FIGS. 4 and 5; also the basic design is similar. The main difference as compared to the embodiment shown in FIG. 4 is that the blade or vane members 6d are pivotally mounted on the box-like profile members constituting the support arms 3. For this purpose, the outwardly oriented front edges of the support arms 3 are provided on either side with slotted hollow cylindrical bearing slots 15 constituting a first hinge portion. The second cooperating hinge portion is constituted by a cylindrical body 16 which forms part of blade members 6d and which is provided thereon along the outer edge. Due to the fact that the partly longitudinally slotted jacket of the first hinge portion 15 has two free longitudinal edges, two stops for the blade members 6d are formed: The first stop limits the inward pivoting movement of the blade member 6d, i.e. towards the central post member 2, so that the aforementioned slightly acute basic setting angle of the blade member with reference to the side surface 3a is ensured in which the free longitudinal edges of two adjacent blade members 6d are close to one another or even just in contact with each other (right-hand half of FIG. 6). The second stop limits the outward pivoting movement of the blade members 6d in such a way that when they are in a fully swung out position, they extend approximately parallel to the lateral arm surface 3a (left-hand half of FIG. 6).

FIGS. 7a to 7d show different variations of a further embodiment, as far as the design of the blade or vane members 6 are concerned; however their basic design is similar to the one shown in FIG. 6.

FIG. 7a shows that the blade members 6e may be provided on their free longitudinal edges with guiding protrusions 17 which preferably form part of the blade or vane members 6e and which extend at a slightly acute angle therefrom towards the centre of the post 2. The blade or vane members 6e are plane pieces e.g. made of aluminium or plastic; the protrusions 17 may be constructed of the same material.

FIG. 7b shows that the blade members 6f can be constructed in curved shape with a constantly decreasing radius of curvature, as seen from the pivoting axis thereof. The end portions 17a which have a relatively pronounced curvature thereby provide the function of the guiding elements, similar to those shown in FIG. 7a.

FIG. 7c illustrates that the blade or vane members 6g may be constituted by planar body members whose end portions 17b are bent inwards so that they fulfil the function of the afore-mentioned guidance elements, however to a somewhat reduced extent.

FIG. 7d finally shows an embodiment in which the blade or vane members 6h are constituted by slightly curved or domed body members without pronounced guidance elements being provided.

The function of the guidance protrusions or the edge portions serving as such guidance elements is mainly to assist in introducing the downwardly hanging clothes line portions into the cavities 14 and to force the retracted clothes line portions towards the two lateral inner surfaces of these cavities. Of course it is also possible to provide separate guide members (not shown) displaceably mounted along the support arms and which bring about a forced guidance of the hanging down line portions into the cavities. However, the design of such guide members is not the object of the present invention, is therefore not shown in the drawings and need not therefore be explained in detail here.

The handling and operation of the clothes drying apparatus differ as a function whether the support arms 3 are provided with rigid or pivotable blade members 6. In the case of rigid blade members (e.g. 6a or 6b), no real additional operative step is required. On folding together the clothes drying apparatus 1 from the operating, folded out position into the swung in, inoperative position, it may be necessary to provide manual assistance to ensure that the increasingly downwardly hanging clothes line portions 7' slide behind the blade members and are safely received and "packed" in the cavities provided for this purpose. If the aforementioned displaceably mounted guide members are provided, there should be no need for manual assistance since an automatic enclosure of the downwardly hanging clothes line portions may be expected.

In the case of pivotally mounted blade members (e.g. 6d or 6e–6h), which preferably have a certain friction within their pivot bearing, it is to be expected that the individual blade members will be automatically swung out during the folding out of the clothes drying apparatus under the influence of the tensioning clothes line portions. Following the extension of the apparatus in its operative position, they can optionally be brought into their completely swung out position if necessary or desired. However, on folding together the clothes drying apparatus, the blade or vane members remain in their swung out position until the support arms have been completely swung in. If there are no displaceably mounted guide members, the downwardly hanging clothes line portions are passed by the guidance protrusions mounted on the blade members into the cavities provided for receiving the line portions to a great extent. Maybe a slight manual assistance may be required so that the blade members can be closed. If displaceable guide elements are available or provided, it is merely necessary to manually fold together the blade members following the collapsing of the clothes drying apparatus. It is also conceivable to automate this operation by an appropriate design of the clothes dryer mechanism, but there is no need to explain this further since this not an object of the present invention.

What I claim is:

1. A clothes drying apparatus comprising:

a central, elongate supporting post member;

a collar member surrounding said central supporting post member and including a plurality of radially protruding webs, the collar member being axially displaceably mounted on said central supporting post member;

a plurality of support arms, one end of each support arm being pivotally mounted via a first joint on a respective radially protruding web, and a clothes line comprising a plurality of clothes line portions extending between said support arms;

a head member mounted at the top of said central supporting post member;

a plurality of strut members, each of said plurality of strut members having one end thereof pivotally connected to said head member and the other end thereof pivotally connected via a second joint to a respective one of said plurality of support arms;

operating means adapted to spread said support arms from a rest position, in which the arms are in an essentially parallel position with regard to the central supporting post member, into an extended position in which the clothes line portions extending between the support arms are in an essentially tensioned condition by displacing said collar member from a lower rest position towards said head member;

when said support arms are in said essentially parallel position with regard to said central supporting post, at least partially closed cavities are formed between said support arms and said central supporting post, said cavities receiving and enclosing the downwardly hanging clothes line portions of said clothes line;

said support arms being provided with laterally projecting blades extending at least along a part of their longitudinal extent which blades, when said support arms are in their retracted inoperative position, together with the lateral faces of the support arms and the surface of the central supporting post, form the cavities for receiving the downwardly hanging clothes line portions, said laterally projecting blades being pivotally attached to said support arms.

2. A clothes drying apparatus according to claim 1, in which for the pivotable mounting of said laterally projecting blades, hinge-like joints are provided which have stops for limiting the pivoting movement of the blades.

3. A clothes drying apparatus according to claim 2, in which the hinge-like joints are provided with stop means operative in both pivoting directions of the blades which limit the pivoting movement of the blades, on the one hand, in a swung-in position inclined at an acute angle to the lateral face of the support arms and, on the other hand, in a swung-out position running essentially parallel to the lateral face of the support arms.

4. A clothes drying apparatus comprising:

a central, elongate supporting post member;

a collar member surrounding said central supporting post member and including a plurality of radially protruding webs, the collar member being axially displaceably mounted on said central supporting post member;

a plurality of support arms, one end of each support arm being pivotally mounted via a first joint on a respective radially protruding web, and a clothes line comprising a plurality of clothes line portions extending between said support arms;

a head member mounted at the top of said central supporting post member;

a plurality of strut members, each of said plurality of strut members having one end thereof pivotally connected to said head member and the other end thereof pivotally connected via a second joint to a respective one of said support arms; and operating means adapted to spread said support arms from a rest position, in which the arms are in an essentially parallel position with regard to the central supporting post member, into an extended position in which the clothes line portions extending between the support arms are in an essentially tensioned condition, by displacing said collar member from a lower rest position towards said head member;

said support arms having means, which when said support arms are in said essentially parallel position with regard to said central supporting post, form a plurality of essentially closed cavities between said support arms and said central supporting post, said cavities receiving and enclosing the downwardly hanging clothes line portions of said clothes line.

5. A clothes drying apparatus according to claim 4, in which said means comprises laterally projecting blades extending along at least a part of the longitudinal extent of said support arems and which blades, when said support arms are in their retracted inoperative position, together with the lateral faces of the support arms and the surface of the central supporting post form said essentially closed cavities.

6. A clothes drying apparatus according to claim 5, in which said laterally projecting blades are rigidly fixed to said support arms.

7. A clothes drying apparatus according to claim 6, in which said laterally projecting blades are integrally formed with said support arms.

8. A clothes drying apparatus according to claim 5 in which said support arms are provided on both sides with said projecting blades.

9. A clothes drying apparatus according to claim 5, in which the blades are mounted on or fixed to the outer edges of the support arms remote from the central post member.

10. A clothes drying apparatus according to one of the claims 5, 6, 7, 8 and 9, in which the blades are inclined under an acute angle to the lateral face plane of the support arms.

11. A clothes drying apparatus according to claim 5, in which the blades are formed by elongated planar members.

12. A clothes drying apparatus according to claim 11, in which the blades are provided with guidance extensions arranged along their free longitudinal edges and which project towards the central post member.

13. A clothes drying apparatus according to claim 5, in which the blades are formed by elongated curved members.

* * * * *